US009424802B2

(12) United States Patent
Braham et al.

(10) Patent No.: US 9,424,802 B2
(45) **Date of Patent: *Aug. 23, 2016**

(54) ASSISTANCE FOR COLOR RECOGNITION

(71) Applicant: International Business Machines Corporation, Armonk, NY (US)

(72) Inventors: Adam D. Braham, Rochester, MN (US); Jennifer A. Haugen, Rochester, MN (US); Jeffrey A. Schmidt, Rochester, MN (US); Lowell C. Thomason, Kasson, MN (US)

(73) Assignee: International Business Machines Corporation, Armonk, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/799,952

(22) Filed: Jul. 15, 2015

(65) Prior Publication Data

US 2015/0317946 A1 Nov. 5, 2015

Related U.S. Application Data

(63) Continuation of application No. 13/528,808, filed on Jun. 20, 2012, now Pat. No. 9,142,186.

(51) Int. Cl.
*G09G 5/02* (2006.01)
*G09G 5/06* (2006.01)

(52) U.S. Cl.
CPC ..... *G09G 5/02* (2013.01); *G09G 5/026* (2013.01); *G09G 5/06* (2013.01); *G09G 2340/06* (2013.01); *G09G 2354/00* (2013.01)

(58) Field of Classification Search
CPC ..... G09G 5/14; G09G 2340/10; G09G 2340/125; G06T 11/60; H04N 5/44504
See application file for complete search history.

(56) References Cited

U.S. PATENT DOCUMENTS

| | | | | |
|---|---|---|---|---|
| 6,784,905 | B2 | 8/2004 | Brown et al. | |
| 7,145,571 | B2 | 12/2006 | Jones et al. | |
| 7,916,152 | B2 | 3/2011 | Jones et al. | |
| 9,142,186 | B2 * | 9/2015 | Braham ..... | G09G 5/02 |
| 2004/0085327 | A1 | 5/2004 | Jones et al. | |
| 2006/0209258 | A1 | 9/2006 | Nareppa et al. | |
| 2007/0091113 | A1 | 4/2007 | Jones et al. | |
| 2010/0321400 | A1 | 12/2010 | Miyahara | |
| 2011/0229023 | A1 | 9/2011 | Jones et al. | |
| 2011/0293177 | A1 | 12/2011 | Wang et al. | |
| 2011/0305386 | A1 | 12/2011 | Wang et al. | |

(Continued)

OTHER PUBLICATIONS

Alan T. Buttram, USPTO Office Action, U.S. Appl. No. 13/528,808, Notification Date Jul. 23, 2014, 19 pages.
Alan T. Buttram, USPTO Final Office Action, U.S. Appl. No. 13/528,808, Notification Date Dec. 24, 2014, 17 pages.

(Continued)

*Primary Examiner* — Todd Buttram
(74) *Attorney, Agent, or Firm* — William H. Hartwell; Maxine L. Barasch; Keohane & D'Alessandro PLLC

(57) ABSTRACT

Embodiments of the present invention provide an approach for processing a color image for a color blind person to perceive color variation within the color image. Specifically, in a typical embodiment, a color image is received from an image capture device or other means. Each area of the color image having one of a specific color or color combination is determined. A pattern is generated based on the one of the specific color or color combination. A pattern overlay of the generated pattern is rendered on a display device.

20 Claims, 7 Drawing Sheets

(56) References Cited

U.S. PATENT DOCUMENTS

| | | | |
|---|---|---|---|
| 2013/0027420 | A1 | 1/2013 | Felt |
| 2013/0342555 | A1 | 12/2013 | Braham et al. |

OTHER PUBLICATIONS

Alan T. Buttram, USPTO Notice of Allowance and Fee(s) Due, U.S. Appl. No. 13/528,808, Date Mailed Apr. 13, 2015, 12 pages.

* cited by examiner

ASSISTANCE FOR COLOR RECOGNITION

CROSS-REFERENCE TO RELATED APPLICATIONS

The present patent document is a continuation of U.S. patent application Ser. No. 13/528,808, filed Jun. 20, 2012, entitled "ASSISTANCE FOR COLOR RECOGNITION", the disclosure of which is incorporated herein by reference.

TECHNICAL FIELD

In general, embodiments of the present invention provide an approach for image processing. Specifically, embodiments of the present invention relate to an approach for processing an image for a color blind person to perceive color variation within an image.

BACKGROUND

Color blind persons are often unable to reliably distinguish between various colors. Persons whose color vision is impaired include, for example, those who confuse reds and greens (e.g., either protanopia: having red cones that are not fully functional; or deuteranopia: having green cones that are not fully functional). Even people with full color vision can, at times, have difficulty distinguishing between colors. As a person ages, clouding of the lenses of the person's eyes tends to occur due, for example, to cataracts. As individuals age, they often experience changes in their ability to sense colors. Some individuals may see objects as if they have been viewed through yellowish filters. Additionally, over time, ultraviolet rays degenerate proteins in the eye, and light having short wavelengths is absorbed and blue cone sensitivity is thereby reduced. As a result, the appearance of all colors changes. Similarly, even an individual with "normal" vision can perceive colors differently when they are at an altitude that is greater than they are normally used to, or under certain medications.

To overcome the inability to distinguish colors, individuals may become adept at identifying and learning reliable cues that indicate the color of an object, such as by knowing that a stop sign is red or that a banana is typically yellow. However, absent these cues, the effect of being color blind is that they are often unable to reliably distinguish colors of various objects and images, including in cases where the color provides information that is important or even critical to an accurate interpretation of the object or image. Common examples of such objects and images include lighted and non-lighted traffic signals, and pie charts/graphs of financial information and maps. Moreover, with the proliferation of color computer displays and mobile devices, more and more information is being delivered electronically and visually and usually with color coded information.

SUMMARY

In general, embodiments of the present invention provide an approach for processing a color image for a color blind person to perceive color variation within the color image. Specifically, in a typical embodiment, a color image is received from an image capture device or other means. Each area of the color image having one of a specific color or color combination is determined. A pattern is generated based on the one of the specific color or color combination. A pattern overlay of the generated pattern is rendered on a display device.

A first aspect of the present invention provides a computer-implemented method for processing a color image, comprising: receiving a color image; determining an area of the color image having one of a specific color or color combination; generating a pattern based on the one of the specific color or color combination; and rendering a pattern overlay based on the generated pattern on a display device.

A second aspect of the present invention provides a system for processing a color image, comprising: a memory medium comprising instructions; a bus coupled to the memory medium; and a color image processing tool coupled to the bus that when executing the instructions causes the system to: receive a color image; determine an area of the color image having one of a specific color or color combination; generate a pattern based on the one of the specific color or color combination; and render a pattern overlay based on the generated pattern on a display device.

A third aspect of the present invention provides a computer program product for processing a color image, the computer program product comprising a computer readable storage medium, and program instructions stored on the computer readable storage medium, to: receive a color image; determine an area of the color image having one of a specific color or color combination; generate a pattern based on the one of the specific color or color combination; and render a pattern overlay based on the generated pattern on a display device.

A fourth aspect of the present invention provides a method for deploying a system for processing a color image, comprising: providing a computer infrastructure being operable to: receive a color image; determine an area of the color image having one of a specific color or color combination; generate a pattern based on the one of the specific color or color combination; and render a pattern overlay based on the generated pattern on a display device.

BRIEF DESCRIPTION OF THE DRAWINGS

These and other features of this invention will be more readily understood from the following detailed description of the various aspects of the invention taken in conjunction with the accompanying drawings in which.

Figure 1:
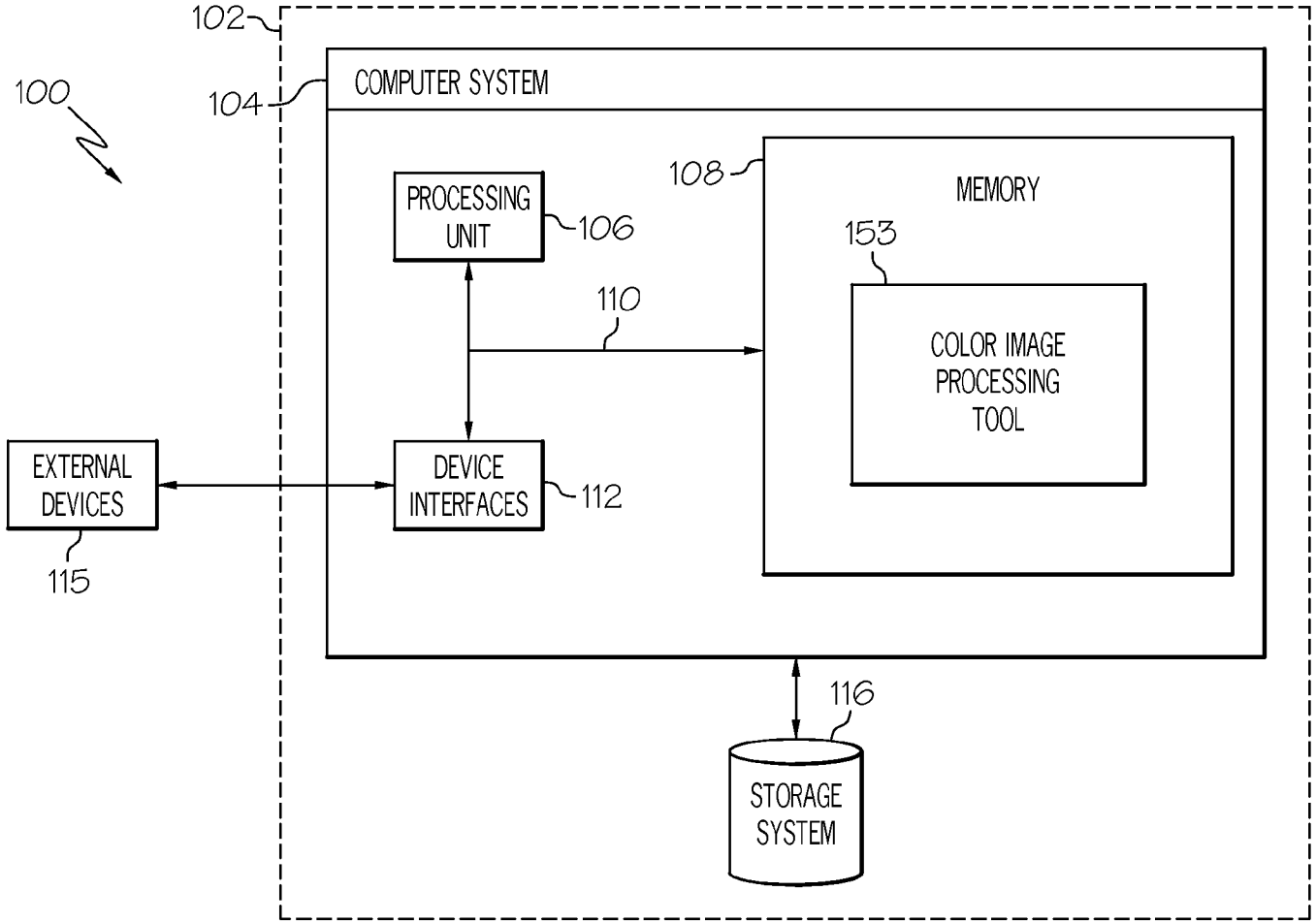
FIG. 1 shows a computerized implementation of the present invention.

The drawings are not necessarily to scale. The drawings are merely schematic representations, not intended to portray specific parameters of the invention. The drawings are intended to depict only typical embodiments of the invention, and therefore should not be considered as limiting the scope of the invention. In the drawings, like numbering represents like elements.

DETAILED DESCRIPTION

Embodiments of the present invention provide an approach for processing a color image for a color blind person to perceive color variation within the color image. Specifically, in a typical embodiment, a color image is received from an image capture device or other means. Each area of the color image having one of a specific color or color combination is determined. A pattern is generated based on the one of the specific color or color combination. A pattern overlay of the generated pattern is rendered on a display device.

Some devices have been developed to assist color blind individuals with recognizing important color coded information. Although such devices provide some benefit, they are cumbersome to use and have limited effectiveness in that only one color is adjusted, and the individual cannot expand or change the manner in which the device alters the perceived color space.

Thus, an individual viewing a pie chart that includes colors that are outside of the perceptible color space of his or her vision will have only a moderately improved understanding of the information being conveyed in the pie chart. Therefore, a great load is imposed on such persons when they must read or edit data using a color computer display terminal or mobile device. In addition, these users cannot locate information on a screen that is displayed using certain colors or color combinations, and thus might not be able to read important notices. For example, when such an individual employs a resource or service provided via the Internet, it may be that important or cautionary information are displayed using characters in colors that the individual may not be able to distinguish.

FIG. 1 illustrates a computerized implementation 100 of the present invention. As depicted, implementation 100 includes computer system 104 deployed within a computer infrastructure 102. This is intended to demonstrate, among other things, that the present invention could be implemented within a network environment (e.g., the Internet, a wide area network (WAN), a local area network (LAN), a virtual private network (VPN), etc.), or on a stand-alone computer system. In the case of the former, communication throughout the network can occur via any combination of various types of communications links. For example, the communication links can comprise addressable connections that may utilize any combination of wired and/or wireless transmission methods. Where communications occur via the Internet, connectivity could be provided by conventional TCP/IP sockets-based protocol, and an Internet service provider could be used to establish connectivity to the Internet. Still yet, computer infrastructure 102 is intended to demonstrate that some or all of the components of implementation 100 could be deployed, managed, serviced, etc., by a service provider who offers to implement, deploy, and/or perform the functions of the present invention for others.

Computer system 104 is intended to represent any type of computer system that may be implemented in deploying/realizing the teachings recited herein. In this particular example, computer system 104 represents an illustrative system for constructing a SOA shared service. It should be understood that any other computers implemented under the present invention may have different components/software, but will perform similar functions. As shown, computer system 104 includes a processing unit 106, memory 108 for storing a color image processing tool 153, a bus 110, and device interfaces 112.

Processing unit 106 collects and routes signals representing outputs from external devices 115 (e.g., a keyboard, a pointing device, a display, a graphical user interface, etc.) to color image processing tool 153. The signals can be transmitted over a LAN and/or a WAN (e.g., T1, T3, 56 kb, X.25), broadband connections (ISDN, Frame Relay, ATM), wireless links (802.11, Bluetooth, etc.), and so on. In some embodiments, the signals may be encrypted using, for example, trusted key-pair encryption. Different external devices may transmit information using different communication pathways, such as Ethernet or wireless networks, direct serial or parallel connections, USB, Firewire®, Bluetooth®, or other proprietary interfaces. (Firewire is a registered trademark of Apple Computer, Inc. Bluetooth is a registered trademark of Bluetooth Special Interest Group (SIG)).

In general, processing unit 106 executes computer program code, such as program code for operating color image processing tool 153, which is stored in memory 108 and/or storage system 116. While executing computer program code, processing unit 106 can read and/or write data to/from memory 108 and/or storage system 116. Storage system 116 can include VCRs, DVRs, RAID arrays, USB hard drives, optical disk recorders, flash storage devices, or any other similar storage device. Although not shown, computer system 104 could also include I/O interfaces that communicate with one or more external devices 115 that enable a user to interact with computer system 104.

Figure 2:
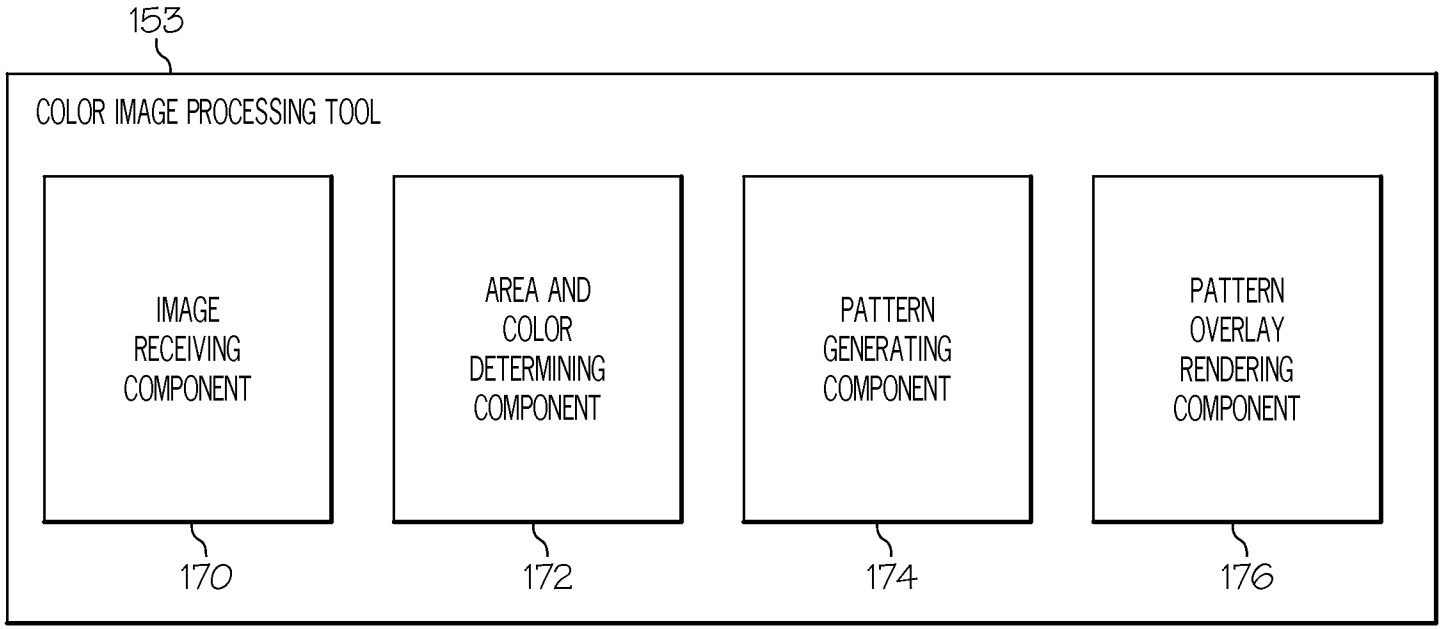
FIG. 2 shows a more detailed view of an example color image processing tool according to an embodiment of the present invention.

FIG. 2 shows a more detailed view of an example color image processing tool 153. Color image processing tool 153 includes an image receiving component 170, an area and color determining component 172, a pattern generating component 174, and pattern overlay rendering component 176.

Image receiving component 170 may be configured to receive a color image. In one example, the color image may be received from an image capture device, such as a camera. In other examples, the color image may be retrieved by other means. Area and color determining component 172 may be configured to determine an area of the color image having a specific color or color combination, along with the color or color combination of the area. Pattern generating component 174 may be configured to generate a pattern based on the color or color combination of the area. Pattern overlay rendering component 176 may be configured to render a pattern overlay using the generated pattern on a display device, such as a liquid crystal display (LCD) device or a cathode ray tube (CRT) monitor.

The process may be repeated for one or more areas of the color image. In a typical example, the process is repeated until the entire color image is processed. A color-blind person may view the rendered pattern(s) and be able to recognize the actual color(s) of the color image. In one example, the pitch of one or more lines is varied to represent the amount of that color in that respective area. A pattern associated with a color may comprise one or more lines, dots, geometric shapes, characters, symbols, or the like.

Figure 3B:
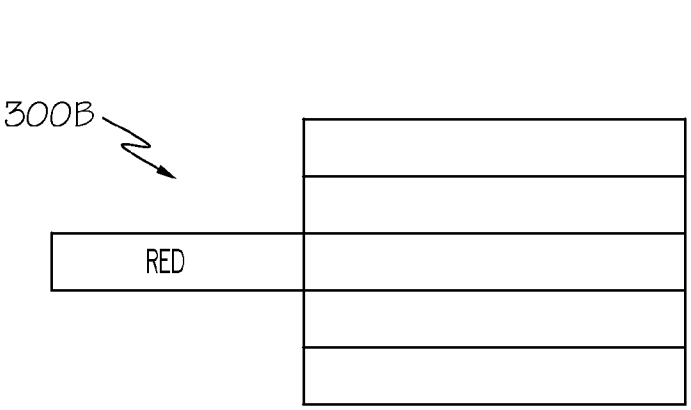
FIGS. 3A-C show an example pattern for each of the three primary colors according to an embodiment of the present invention.
Figure 3A:
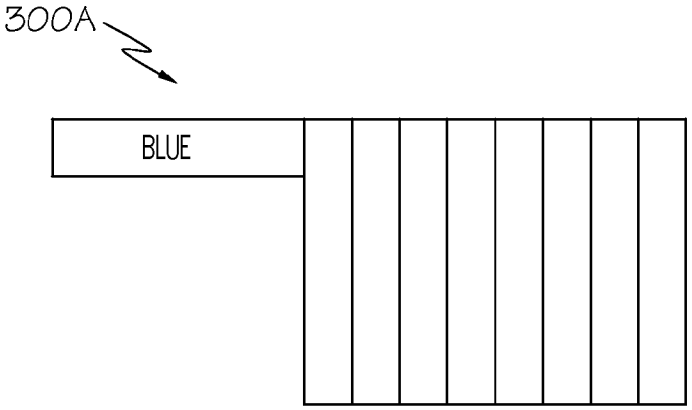
Figure 3C:
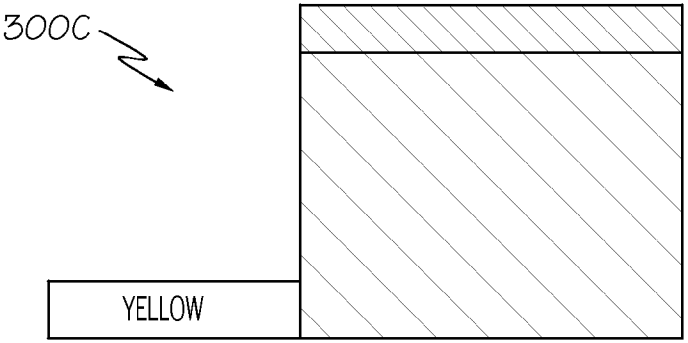

FIGS. 3A-C show an example pattern for each of the three primary colors according to an embodiment of the present invention. The three primary colors (blue, red, and yellow) cannot be created through the mixing of other colors. They are colors in their own right. In a typical example, each of the three primary colors may have their own unique pattern. In FIG. 3A, the example pattern 300A of vertical lines represents blue. In FIG. 3B, the example pattern 300B of horizontal lines represents red. In FIG. 3C, the example pattern 300C of yellow lines represents yellow. In other examples, different patterns may be used to represent the primary colors.

Figure 4B:
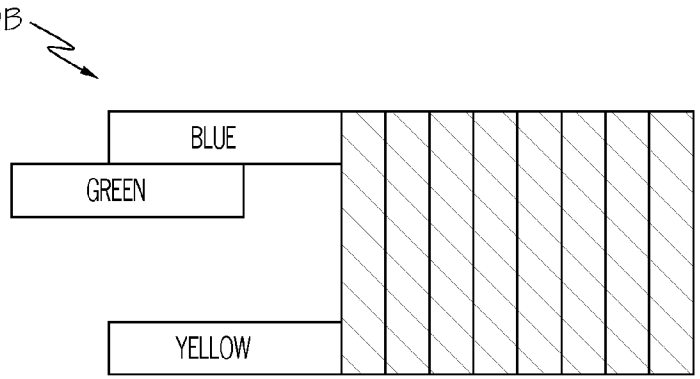
FIGS. 4A-C show an example pattern for each of three three secondary colors according to an embodiment of the present invention.
Figure 4A:
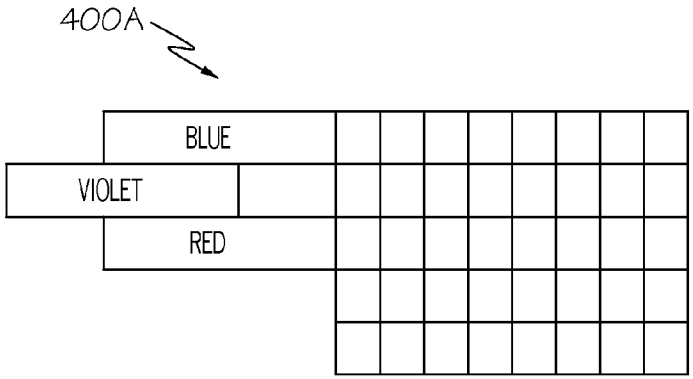
Figure 4C:
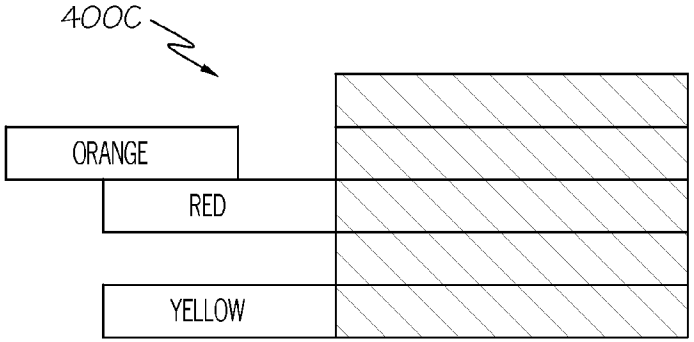

FIGS. 4A-C show an example pattern for each of the three secondary colors according to an embodiment of the present invention. Primary colors can be mixed together to produce secondary colors (violet, green, and orange). Lines representing the primary colors are blended to represent secondary or tertiary colors that would result from the blending of the underlying primary colors. FIG. 4A shows an example pattern 400A for violet which is produced by a combination of equal parts blue (vertical lines) and red (horizontal lines) as shown in FIGS. 3A and 3B, respectively. FIG. 4B shows an example pattern 400B for green which is produced by a combination of equal parts blue (vertical lines) and yellow (diagonal lines) as shown in FIGS. 3A and 3C, respectively. FIG. 4C shows an example pattern 400C for orange which is produced by a combination of equal parts red (horizontal lines) and yellow (diagonal lines) as shown in FIGS. 3B and 3C, respectively.

FIGS. 5A-F show an example pattern for each of six tertiary colors according to an embodiment of the present invention. The tertiary colors are red-violet, blue-violet, blue-green, yellow-green, yellow-orange, and red-orange. A tertiary color is a color made by mixing either one primary color with one secondary color, or two secondary colors.

Figure 5B:
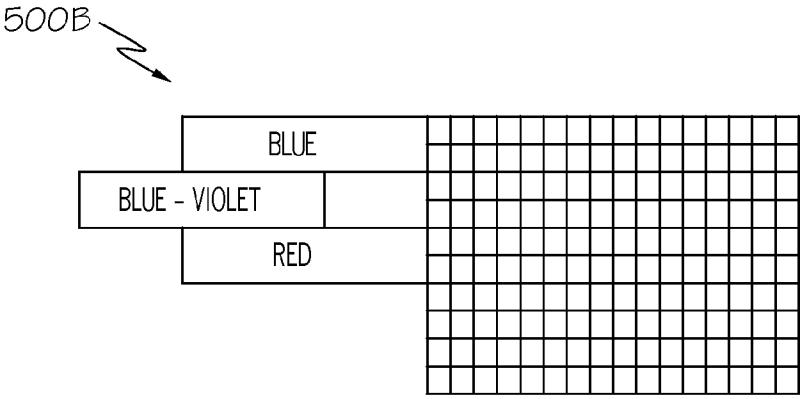
FIGS. 5A-F show an example pattern for each of six tertiary colors according to an embodiment of the present invention.
Figure 5A:
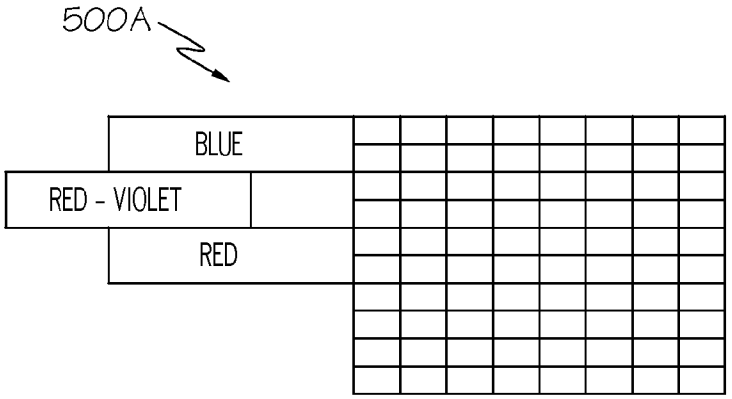
Figure 5C:
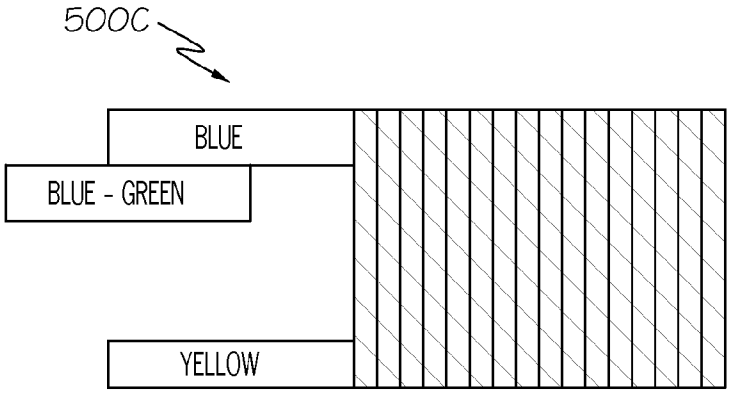
Figure 5E:
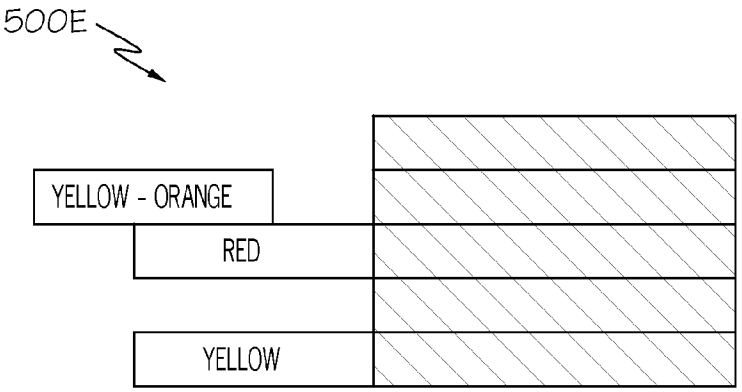
Figure 5D:
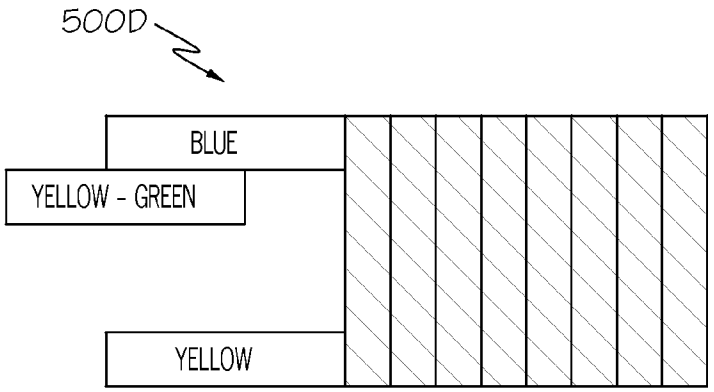
Figure 5F:
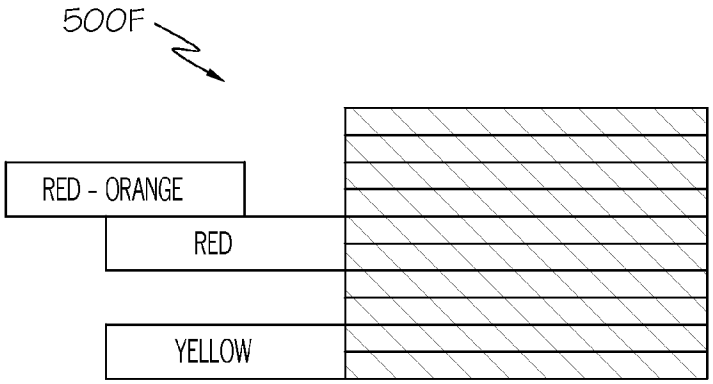

FIG. 5A shows an example pattern 500A for red-violet. The red-violet pattern is not equal parts of blue (vertical lines) and red (horizontal lines). Rather, the pattern is two parts blue and one part red. Thus, the red-violet pattern blends blue (vertical lines) having twice as many lines as red (horizontal lines). FIG. 5B shows an example pattern 500B for blue-violet. The blue-violet pattern blends two parts red (horizontal lines) and one part blue (vertical lines). FIG. 5C shows an example pattern 500C for blue-green blending colors blue and yellow. FIG. 5D shows an example pattern 500D for yellow-green blending colors blue and yellow. FIG. 5E shows an example pattern 500E for yellow-orange blending colors red and yellow. FIG. 5F shows an example pattern 500F for red-orange blending colors red and yellow.

Figure 6:
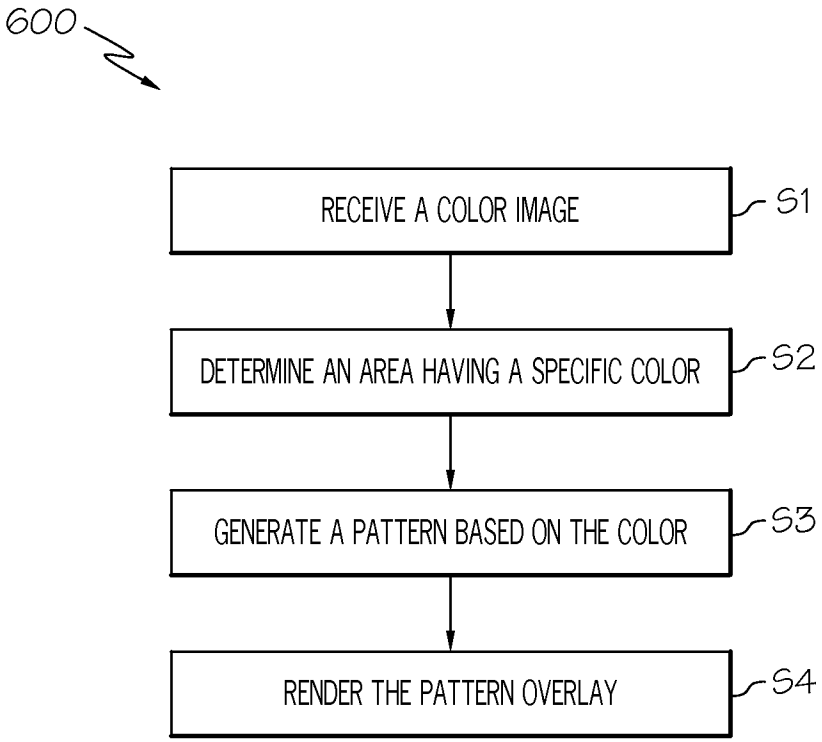
FIG. 6 shows a method flow diagram for processing a color image for a color blind person to perceive color variation within the color image according to an embodiment of the present invention.

FIG. 6 shows a method flow diagram 600 for processing a color image for a color blind person to perceive color variation within the color image according to an embodiment of the present invention. In S1, a color image is received. In one example, the image may be captured using a photographic device, such as a camera, smartphone, or the like. Is S2, an area having a specific color is determined. In one example, the color may be converted to a color code. In S3, a pattern based on the color is generated. In one example, a table containing each color code and its matching pattern may be accessed to determine the pattern to generate. In S4, the pattern overlay is rendered.

Further, it can be appreciated that the methodologies disclosed herein can be used within a computer system to provide a color image processing service, as shown in FIG. 1. In this case, color image processing tool 153 can be provided, and one or more systems for performing the processes described in the invention can be obtained and deployed to computer infrastructure 102. To this extent, the deployment can comprise one or more of (1) installing program code on a computing device, such as a computer system, from a computer-readable medium; (2) adding one or more computing devices to the infrastructure; and (3) incorporating and/or modifying one or more existing systems of the infrastructure to enable the infrastructure to perform the process actions of the invention.

The exemplary computer system 104 may be described in the general context of computer-executable instructions, such as program modules, being executed by a computer. Generally, program modules include routines, programs, people, components, logic, data structures, and so on that perform particular tasks or implements particular abstract data types. Exemplary computer system 104 may be practiced in distributed computing environments where tasks are performed by remote processing devices that are linked through a communications network. In a distributed computing environment, program modules may be located in both local and remote computer storage medium including memory storage devices.

Furthermore, an implementation of exemplary computer system 104 may be stored on or transmitted across some form of computer readable media. Computer readable media can be any available media that can be accessed by a computer. By way of example, and not limitation, computer readable media may comprise "computer storage medium" and "communications media."

"Computer storage medium" includes volatile and non-volatile, removable and non-removable media implemented in any method or technology for storage of information such as computer readable instructions, data structures, program modules, or other data. Computer storage medium includes, but is not limited to, RAM, ROM, EEPROM, flash memory or other memory technology, CD-ROM, digital versatile disks (DVD) or other optical storage, magnetic cassettes, magnetic tape, magnetic disk storage or other magnetic storage devices, or any other medium which can be used to store the desired information and which can be accessed by a computer.

"Communication media" typically embodies computer readable instructions, data structures, program modules, or other data in a modulated data signal, such as carrier wave or other transport mechanism. Communication media also includes any information delivery media.

The term "modulated data signal" means a signal that has one or more of its characteristics set or changed in such a manner as to encode information in the signal. By way of example, and not limitation, communication media includes wired media such as a wired network or direct-wired connection, and wireless media such as acoustic, RF, infrared, and other wireless media. Combinations of any of the above are also included within the scope of computer readable media.

It is apparent that there has been provided with this invention an approach for processing a color image for a color blind person to perceive color variation within the color image. While the invention has been particularly shown and described in conjunction with a preferred embodiment thereof, it will be appreciated that variations and modifications will occur to those skilled in the art. Therefore, it is to be understood that the appended claims are intended to cover all such modifications and changes that fall within the true spirit of the invention.

What is claimed is:

1. A computer-implemented method for processing a color image, comprising:

receiving a color image;

determining an area of the color image having a color combination comprising a first color and a second color;

generating a first pattern based on the first color;

generating a second pattern based on the second color; and rendering a pattern overlay based on the first pattern and the second pattern, on a display device, wherein, in the pattern overlay, a pitch of the first pattern is based on a proportion of an amount of the first color and an amount of the second color in the color combination.

2. The computer-implemented method of claim 1, wherein a pitch of the second color in the pattern overlay is based on the proportion.

3. The computer-implemented method of claim 1, wherein the step of rendering a pattern overlay comprises overlaying the pattern overlay on the area of the color image.

4. The computer-implemented method of claim 1, wherein the step of generating a first pattern further comprises determining the first pattern by performing a table lookup using the first color.

5. The computer-implemented method of claim 1, wherein the color image is received from a photographic device.

6. The computer-implemented method of claim 1, wherein the first pattern comprises at least one of a plurality of vertical, horizontal, or diagonal lines.

7. The computer-implemented method of claim 1, wherein the first pattern comprises a plurality of symbols.

8. A system for processing a color image, comprising:

a memory medium comprising instructions;

a bus coupled to the memory medium; and a color image processing tool coupled to the bus that when executing the instructions causes the system to:

receive a color image;

determine an area of the color image having a color combination comprising a first color and a second color;

generate a first pattern based on the first color;

generate a second pattern based on the second color; and render a pattern overlay based on the first pattern and the second pattern, on a display device, wherein, in the pattern overlay, a pitch of the first pattern and a pitch of the second pattern are each based on a proportion of an amount of the first color and an amount of the second color in the color combination.

9. The system of claim 8, wherein a pitch of the second color in the pattern overlay is based on the proportion.

10. The system of claim 8, the memory medium further comprising instructions for causing the system to render the pattern overlay by overlaying the pattern overlay on the area of the color image.

11. The system of claim 8, the memory medium further comprising instructions for causing the system to determine the first pattern by performing a table lookup using the first color.

12. The system of claim 8, wherein the color image is received from a photographic device.

13. The system of claim 8, wherein the first pattern comprises at least one of a plurality of vertical, horizontal, or diagonal lines.

14. The system of claim 8, wherein the first pattern comprises a plurality of symbols.

15. A computer program product for processing a color image, the computer program product comprising a computer readable storage medium, and program instructions stored on the computer readable storage medium, to:

receive a color image;

determine an area of the color image having a color combination comprising a first color and a second color;

generate a first pattern based on the first color;

generate a second pattern based on the second color; and render a pattern overlay based on the first pattern and the second pattern, on a display device, wherein, in the pattern overlay, a pitch of the first pattern and a pitch of the second pattern are each based on a proportion of an amount of the first color and an amount of the second color in the color combination; wherein the computer readable storage medium is not a transitory signal per se.

16. The computer program product of claim 15, wherein a pitch of the second color in the pattern overlay is based on the proportion.

17. The computer program product of claim 15, the computer readable storage medium further comprising instructions to render the pattern overlay by overlaying the pattern overlay on the area of the color image.

18. The computer program product of claim 15, the computer readable storage medium further comprising instructions to determine the first pattern by performing a table lookup using the first color.

19. The computer program product of claim 15, wherein the color image is received from a photographic device.

20. The computer program product of claim 15, wherein the first pattern comprises at least one of a plurality of vertical lines, horizontal, or diagonal lines, or a plurality of symbols.

* * * * *